US005654868A

United States Patent [19]

Buer

[11] Patent Number: 5,654,868

[45] Date of Patent: Aug. 5, 1997

[54] SOLID-STATE EXCITER CIRCUIT WITH TWO DRIVE PULSES HAVING INDENDENTLY ADJUSTABLE DURATIONS

[75] Inventor: Richard W. Buer, Cortland, N.Y.

[73] Assignee: SL Aburn, Inc., Auburn, N.Y.

[21] Appl. No.: 549,416

[22] Filed: Oct. 27, 1995

[51] Int. Cl.[6] ..... F23Q 3/00; F23Q 5/00

[52] U.S. Cl. ..... 361/256; 361/257; 315/209 CD; 123/640; 123/641

[58] Field of Search ..... 361/253, 256, 361/257, 263; 315/209 CD; 123/620, 621, 622, 640, 641, 644, 650, 651, 652, 653, 654, 656

[56] References Cited

U.S. PATENT DOCUMENTS

| | | | |
|---|---|---|---|
| 3,760,782 | 9/1973 | Meyer et al. | 123/604 |
| 4,345,575 | 8/1982 | Jorgensen | 123/598 |
| 4,448,181 | 5/1984 | Ishikawa et al. | 123/620 |
| 4,454,560 | 6/1984 | Nakao et al. | 361/257 |
| 4,510,915 | 4/1985 | Ishikawa et al. | 123/620 |
| 4,886,029 | 12/1989 | Lill et al. | 123/479 |
| 4,915,087 | 4/1990 | Boyer | 123/620 |
| 4,918,389 | 4/1990 | Schleupen et al. | 324/399 |
| 5,023,969 | 6/1991 | Eggers et al. | 361/257 |
| 5,163,411 | 11/1992 | Koiwa | 123/605 |
| 5,178,120 | 1/1993 | Howson et al. | 123/605 |
| 5,207,208 | 5/1993 | Ward | 123/596 |
| 5,215,066 | 6/1993 | Narishige et al. | 123/620 |
| 5,215,067 | 6/1993 | Shimasaki et al. | 123/630 |
| 5,343,154 | 8/1994 | Frus | 324/399 |
| 5,399,942 | 3/1995 | Frus | 315/209 R |
| 5,440,445 | 8/1995 | Balland | 361/257 |

FOREIGN PATENT DOCUMENTS 60-085621 5/1985 Japan .

*Primary Examiner*—Jeffrey A. Gaffin
*Assistant Examiner*—Thuy-Trang N. Huynh
*Attorney, Agent, or Firm*—Harris Beach & Wilcox, LLP

[57] ABSTRACT

A solid-state exciter circuit for establishing arc discharges in igniter devices. The exciter circuit includes first and second transformers, first and second main discharge capacitors, and first and second exciter sub-circuits for controlling the charging and discharging of the latter capacitors. The exciter sub-circuits independently generate component ignition or drive pulses each of which has a magnitude and duration that is optimized for a respective part of an ignition event. The exciter circuit then combines these pulses to produce a composite ignition pulse having voltage and current waveforms that so match the discharge characteristics of an igniter that the latter generates an arc of the desired magnitude and duration substantially without being overexcited or underexcited.

32 Claims, 6 Drawing Sheets

FIG.4A
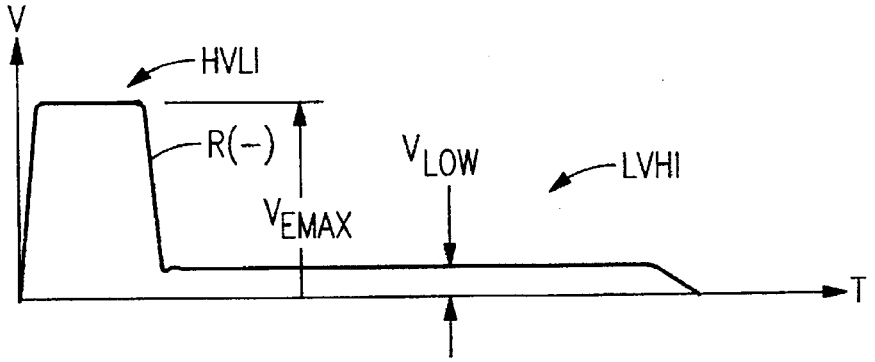
FIG.4B
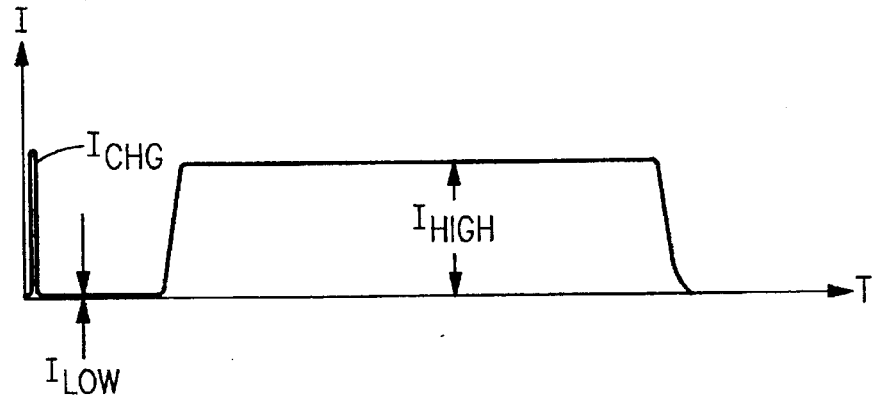
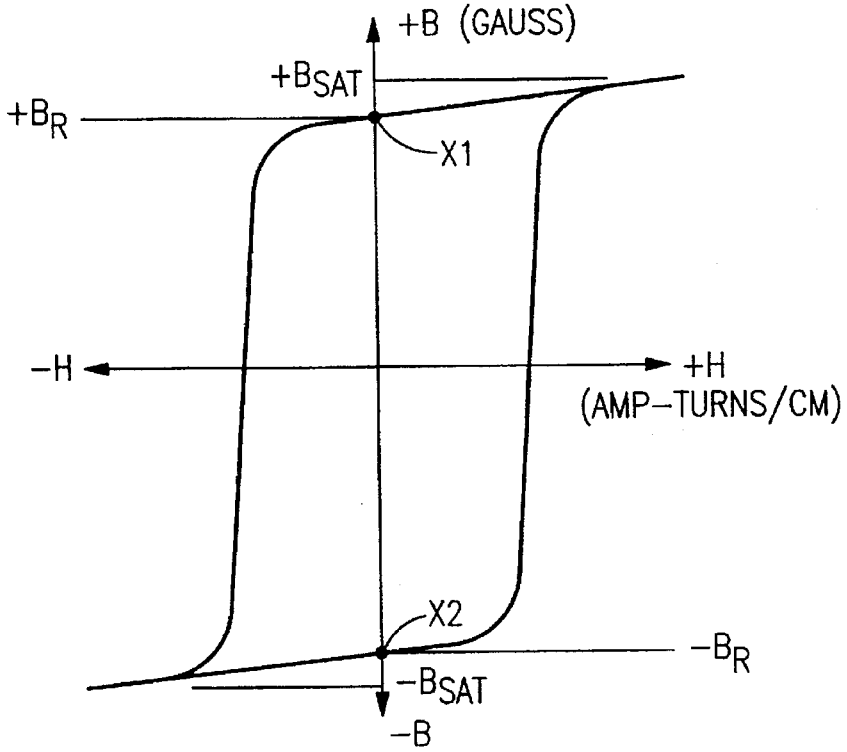
FIG.5

SOLID-STATE EXCITER CIRCUIT WITH TWO DRIVE PULSES HAVING INDENDENTLY ADJUSTABLE DURATIONS

BACKGROUND OF THE INVENTION

The present invention relates to solid-state exciter circuits for establishing arc discharges in igniter devices, and is directed more particularly to a solid-state exciter circuit for establishing arc discharges of improved repeatability and controllability and thereby increasing both the reliability and useful lives of igniter devices.

Energy generating systems which derive their energy from the combustion of fossil fuels all require igniters to ignite the fuel-air mixtures used therein as necessary to maintain the desired rate of energy output. Boilers, for example, use igniters to initiate the combustion of the heavy fuel oil and air mixtures used therein. Ground based turbines, on the other hand, use igniters to initiate the combustion of the natural gas and air mixtures commonly used therein. If the energy output of such systems is regulated by controlling combustion on a cycled or on-off basis, the igniter may be required to ignite the fuel-air mixture at the beginning of each combustion cycle. Additional ignitions may be required if the system is subject to "flame-outs" as a result of transient fluctuations in the rate of fuel and/or air flow.

In exciting the igniters used with such systems, it has long been known that reliable ignition requires the establishment of an arc discharge rather than a glow discharge between the electrodes of the igniter. This is because an arc discharge releases a large quantity of energy as a result of the high current that flows when even a small quantity of metal vapor is present in the ionized air between the igniter electrodes. A glow discharge, on the other hand, releases only a small quantity of energy because only a relatively low current flows when no metal vapor is present in the ionized air between the igniter electrodes.

It has also long been known that a high voltage must be applied between the electrodes of an igniter to initiate an arc discharge, but that relatively low voltages are sufficient to maintain such a current, once it has been established. As a result, it has become a common practice to excite igniters with a two stage ignition pulse that provides a first relatively high voltage at the low current levels that flow before an arc discharge begins, and a second relatively low voltage at the high current levels that flow after an arc discharge has begun.

One example of an ignition apparatus which provides an ignition pulse of the above-mentioned two stage type is described in U.S. Pat. No. 5,163,411 (Koiwa, et al.). In the latter ignition apparatus, a thyristor switch causes two capacitors to simultaneously discharge through respective parts of a primary winding to produce additive voltages and currents in a secondary winding. Because of the differing time constants of these two discharges, the ignition pulse has a high voltage early portion and a lower voltage later portion.

U.S. Pat. No. 5,215,066 (Narishige) describes a broadly similar circuit in which a thyristor switch causes two capacitors to discharge through a primary winding to cooperatively apply an ignition pulse to a spark plug. Because one of the capacitors does not begin to charge until after the other has begun to discharge, the time at which the latter is switched in can be delayed with respect to the former. This, together with the fact that the later discharging capacitor discharges through a current limiting coil, causes the ignition pulse to have the desired two-stage characteristic.

While ignition apparatuses of the above-discussed types are suitable for use with automobile engines, they are not well suited for use with high energy systems such as boilers and ground or air-based turbines. One reason is that automobile engines use a highly volatile fuel-air mixture which is easy to ignite and which supports a combustion that spreads so quickly through its combustion chamber that it is properly regarded as explosive. As a result, even ignition systems which produce relatively short or poorly shaped ignition pulses are adequate for use with automobiles.

In high energy combustion applications, on the other hand, the fuel-air mixtures are much more difficult to ignite and support a combustion that spreads much more slowly through its combustion chamber. As a result, the magnitude, shape and duration of the ignition pulses are much more important than in automotive applications. The sameness of the such pulses from pulse to pulse, i.e., their repeatability, is also much more important in high energy combustion applications than in automotive applications. Such pulses are consequently much more difficult to generate than automotive ignition pulses.

Another reason that ignition devices used in automotive applications are not well suited for high energy combustion applications is that automotive ignition systems do not make the avoidance of misfires an important consideration. This is because, if misfires occur because ignition pulses have the wrong magnitude or duration, the resulting damage is easily and inexpensively corrected. One need only replace one or more damaged spark plugs with inexpensive, easily installed new spark plugs. The adverse effects of such misfires are in any case limited to a single user or small group of users.

In high energy combustion applications, on the other hand, misfires are an important design consideration. One reason is that the igniters used in such systems are considerably more expensive than spark plugs. Another is that igniters handle much greater amounts of energy and consequently may be more seriously damaged by "weak" firings, misfirings and short circuits than spark plugs. The consequences of damage to an igniter may also be much more serious than damage to a spark plug, since the replacement of an igniter may require the shutdown of a system or engine that serves many people.

Because of the serious consequences than can result from the weak firing or misfiring of the igniters of high energy combustion systems, a number of attempts have been made to provide circuitry which can detect and compensate-for such firings. Two such attempts are described in U.S. Pat. Nos. 5,343,154 (Frus) and 5,399,942 (Frus). Such detecting-compensating circuits can, however, be complex and costly and can interfere with the desired normal operation of the exciter as a whole.

In view of the foregoing, it will be seen that a need has existed for an exciter circuit which generates ignition pulses which have a predictable and repeatable waveform, and which is able to detect weak firings or misfirings of igniters and to take prompt action to minimize the igniter damage caused thereby.

SUMMARY OF THE INVENTION

In accordance with the present invention there is provided an improved exciter circuit which generates an ignition pulse having a waveform which is predictable and repeatable, and which may be easily adjusted to accommodate the ignition requirements of combustion systems of a variety of different types.

Generally speaking, the exciter circuit of the invention comprises a multi-capacitor, multi-transformer igniter pulse generating apparatus of the high energy/low tension type. In operation, the exciter circuit independently generates two component ignition or drive pulses each of which has a magnitude, shape and duration which is optimized for a respective phase or part of an ignition event. The exciter circuit then combines these pulses to produce a composite ignition pulse having voltage and current waveforms that so match or track the discharge characteristics of an igniter that the latter generates an arc of the desired magnitude and duration substantially without being overexcited or underexcited.

In accordance with the invention, these component ignition or drive pulses include a first or arc-initiating drive pulse that is produced by discharging a first capacitor through the primary winding of a first transformer under the control of a first drive transistor. The component ignition or drive pulses also include a second or arc-maintaining drive pulse that is produced by discharging a second capacitor through the primary winding of a second transformer under the control of a second drive transistor. Because the discharging of these capacitors takes place through paths that are not connected to one another, and is controlled by transistors having electrically isolated control signals and grounds, these pulses may be independently adjusted to have magnitudes, durations, phase positions, etc. which are independent of one another. On the other hand, because the transformers of the first and second secondary windings are both connected in exciting relationship to the igniter, the igniter responds to them as if they were a single continuous ignition pulse having properties that change during the course of that pulse. Thus, the exciter circuit of the invention provides ignition pulses that are independent in their origins, but cooperative in their application.

In a first, preferred embodiment, the desired cooperation is assured by connecting the secondary windings of the first and second transformers in series with one another, and by providing bypassing circuitry that allows the first primary winding to be bypassed after the end of the arc-initiating phase of the ignition pulse. In a second embodiment, the desired cooperation is assured by connecting the secondary windings of the first and second transformers in parallel with one another, and by providing blocking circuitry that prevents the first secondary winding from producing current in the second secondary winding and vice-versa. In both series and parallel cases, the effect of their common connection to the igniter is minor and does not substantially affect the earlier mentioned ability of the two component ignition pulses to act independently yet cooperatively.

In the preferred embodiment, the exciter circuit of the invention includes arc failure detecting circuitry which is adapted to monitor the exciter drive currents and to detect the occurrence of conditions which indicate that the igniter has failed to produce an arc discharge which is within acceptable limits. One example of such conditions include weak firings or the presence of open or near open circuits, i.e., conditions in which the igniter current has failed to reach a predetermined minimum value by a predetermined time. Another example of such a condition is a condition in which the igniter current is so high that a short circuit or near short circuit is known to be present. To prevent such conditions from damaging or otherwise reducing the useful life of the igniter, the exciter circuit of the invention is arranged to terminate one or both drive pulses, substantially instantaneously, each time that one of these failure conditions occurs.

Advantageously, this shutdown is accomplished in a manner that does not affect the generation of subsequent ignition pulses, thereby assuring that each ignition event begins with a fresh start. This, in turn, prevents any one or more failed ignition events from having a more than proportional effect on the operation of the combustion system as a whole.

In order to facilitate the above-mentioned predictability and repeatability, the igniter circuit of the invention includes discharge circuitry for discharging the first and second capacitors to predetermined standardized values after the respective drive pulse. This discharging circuitry is preferably activated when the respective drive transistors have been turned off either as a result of the completion of the respective drive pulse or as a result of the action of the arc failure detecting circuitry, and assures that the capacitors begin the next phase of their charge-discharge cycle from a known initial voltage.

The igniter circuit of the invention also includes charging circuitry for charging the first and second capacitors to predetermined maximum values after the last mentioned discharging thereof has been completed. This charging circuitry assures that the capacitors begin the next, drive phase of their charge-discharge cycle with a known quantity of stored energy. This, in turn, assures that both of the two components of the composite ignition pulse have predictable and repeatable magnitudes, durations and waveforms.

In embodiments of the invention in which the sizes and/or weights of the transformers are not limiting factors, the above-mentioned discharging and charging circuits are arranged to conduct currents through paths that are independent of (i.e., do not pass through) the windings of the transformers. This independence assures that the discharging and charging of the capacitors does not affect the saturation characteristics of the transformers, or produce unpredictable changes in the magnitude, duration or waveform of the ignition pulse.

In embodiments of the invention in which the size and weight of one or both of the transformers (usually only the second or high current transformer) is a limiting factor, the size and weight of the core thereof may be substantially reduced by directing charging current for the associated capacitor through a winding of the transformer in resetting relationship to the core thereof. The effect of this feature is to establish in that core a magnetic flux having a sign opposite to that produced by the generation of the exciter drive pulse, and having a magnitude sufficient to prevent the core from saturating during that pulse. The achievement of this result is facilitated by the fact that both the size of the capacitor and its minimum and maximum voltage values are known in advance, thereby allowing the amount of this magnetic bias to be accurately and repeatably set at the desired value.

In accordance with a more general feature of the present invention, the drive and preferably also the charge and discharge circuits all include transistors which operate as variable conducting devices, rather than as switching devices. Stated differently, all of these devices operate in a region of their operating characteristics in which they are not driven into saturation in their fully conductive states. In the preferred embodiment, operation as unsaturated devices is assured by providing the transistors with sufficient negative feedback as, for example, by means of a source follower resistor, to assure that the current flow therethrough is limited to safe and predictable values. This negative feedback also substantially reduces the effect of the differences in gain that are typically encountered in different transistors of the same type. Thus, the variable conducting devices prevent the exciter circuit of the invention from generating voltages or currents having extreme or unpredictable values that can shorten the useful life of the igniter.

DESCRIPTION OF THE DRAWINGS

Other objects and advantages of the invention will be apparent from the following description and drawings, in which:

FIG. 4 illustrates the voltage and currents which are associated with a typical ignition pulse;

FIG. 5, is a B-H curve showing the density of the magnetic flux in the core of one of the transformers of FIG. 1 as a function of the magnetomotive force applied thereto.

DESCRIPTION OF THE PREFERRED EMBODIMENTS

Figure 1:
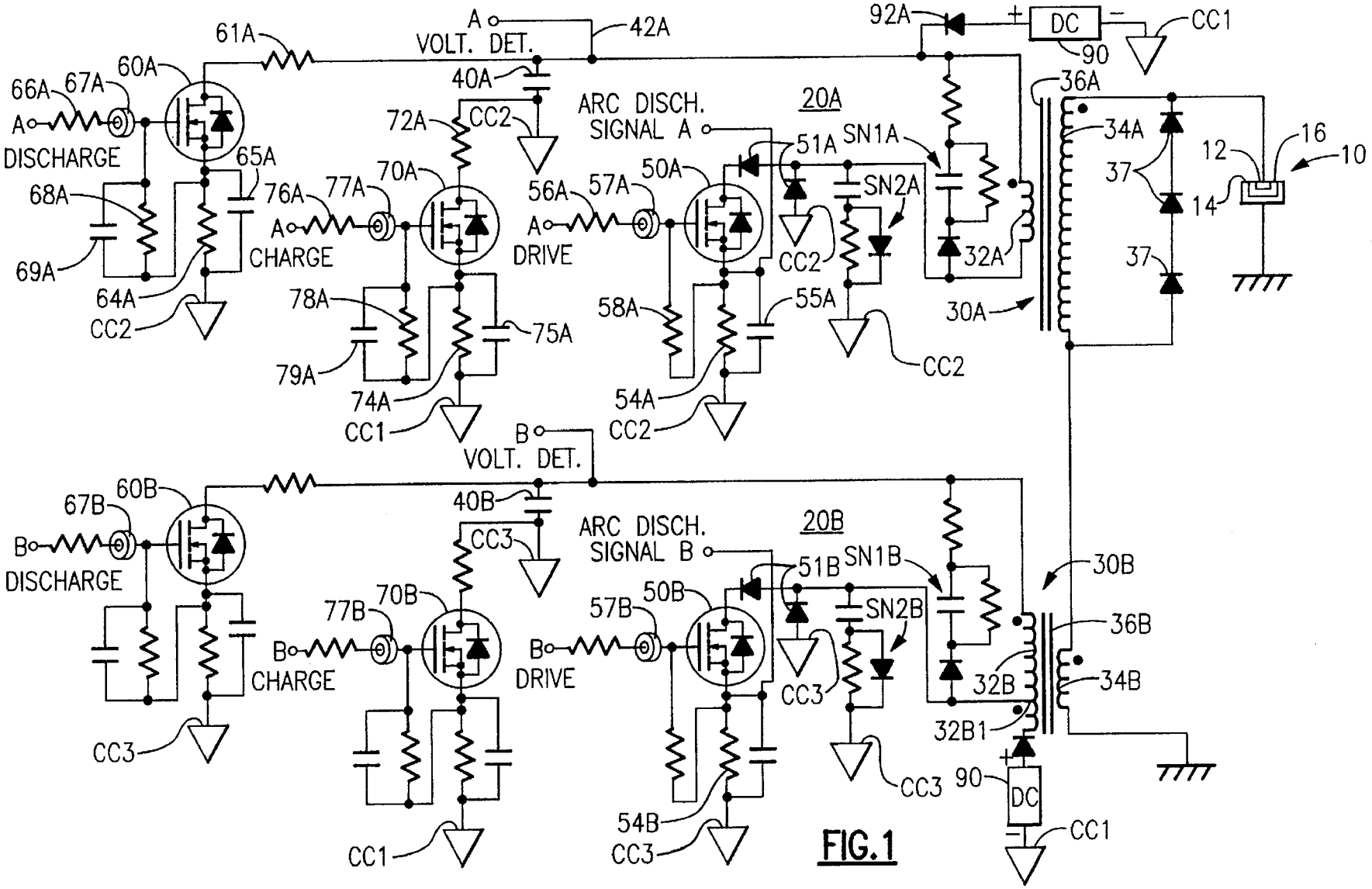
FIG. 1 is a schematic of one embodiment of an exciter circuit constructed in accordance with the present invention.

Referring to the rightmost portion of FIG. 1 there is shown an igniter device 10 of the type used to ignite the fuel-air mixture of a high energy combustion system, such as a boiler or turbine (not shown). Igniter 10 typically includes a metallic inner or center electrode 12, and a metallic outer or rim electrode 14 between which appear the arc or arcs which are used to ignite this mixture. Separating these electrodes is a ceramic based semiconductor pellet or sleeve 16 which may be composed of mixtures of Alumina, Silicon Carbide, etc. that are familiar to those skilled in the art.

Referring to the remainder of FIG. 1, them is shown the exciter circuit which generates the ignition pulses that produce the above-mentioned arcs. Generally speaking, this exciter includes a first exciter sub-circuit 20A which generates a first drive pulse that is responsible for the early, high voltage—low current (HVLI) portion of the ignition pulse, and a second exciter sub-circuit 20B which generates a second drive pulse that is responsible for the late, low voltage-high current (LVHI) portion of the ignition pulse. The first drive pulse is coupled to igniter 10 through a first transformer 30A including a primary winding 32A, a secondary winding 34A and a core 36A. Similarly, the second drive pulse is coupled to igniter 10 through a second transformer 30B including a primary winding 32B, a secondary winding 34B and a core 36B.

In the embodiment of FIG. 1, primary windings 32A and 32B of transformers 30A and 30B are preferably electrically isolated from one another, thereby assuring that the drive pulses which each exciter sub-circuit applies to its primary winding has no appreciable affect on the other primary winding. This isolation is desirable because it allows the voltage, current and timing parameters of these drive pulses to be set and controlled substantially independently of one another. This in turn, allows the voltages and currents of the composite ignition pulse to be adjusted over a wide range and thereby makes it possible for the waveform of the ignition pulse to be optimized for a variety of different applications.

The ability of exciter sub-circuits 20A and 20B to cooperatively control the amplitude and waveshape of the ignition pulse applied to igniter 10 results from the fact that the secondary windings 34A and 34B are both connected in exciting relationship thereto. In the embodiment of FIG. 1, secondary windings 34A and 34B are connected to igniter 10 in series-aiding relationship with one another, de-coupling diodes 37 being provided to allow secondary winding 34A to be bypassed when its contribution to the ignition pulse has ended. In the simplified representation of this embodiment shown in FIG. 1A, this bypassing of secondary winding 34A is shown as a shift in the igniter current from the path P1A to path P2A.

Figure 1A:
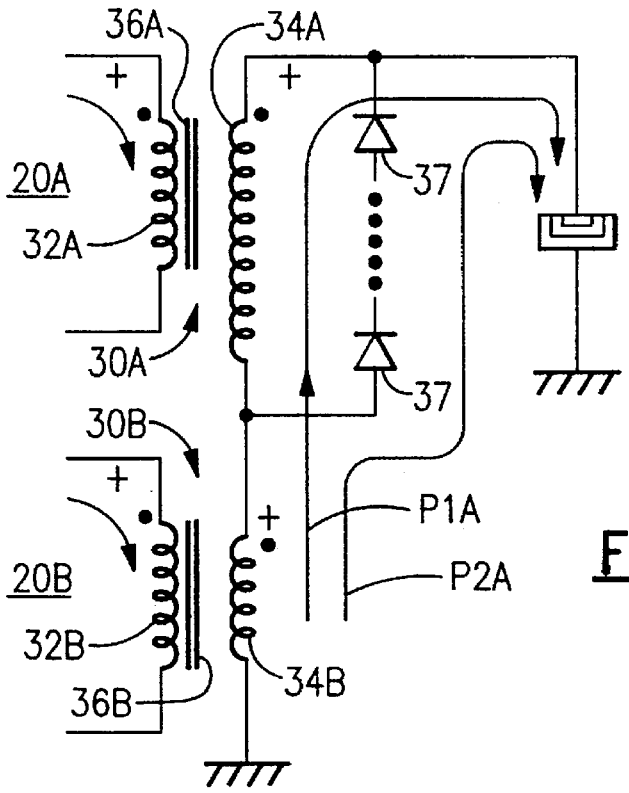
FIGS. 1A and 1B are simplified schematic diagrams of two different secondary winding configurations that may be used in the exciter circuit of the invention.
Figure 1B:
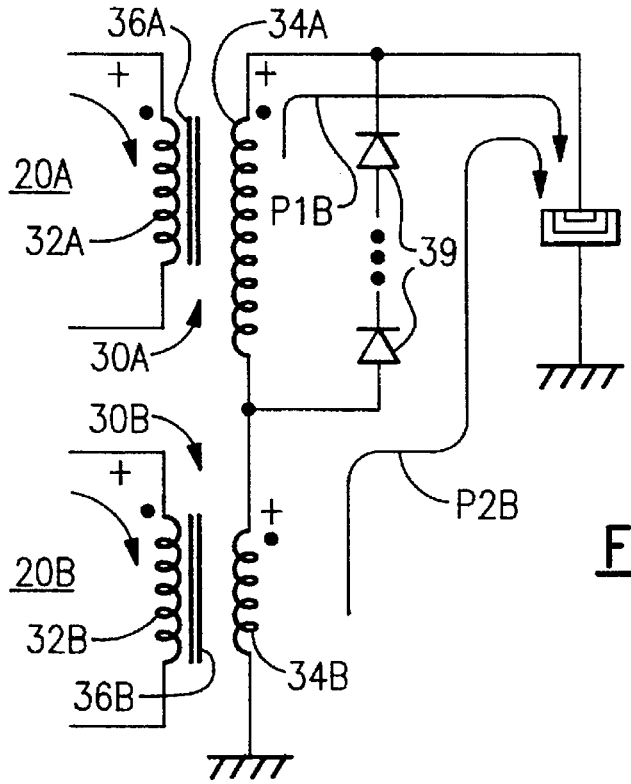

Secondary windings 34A and 34B may also, however, both be connected in exciting relationship to igniter 10 by connecting them in parallel-aiding relationship to one another, as shown in FIG. 1B. In the latter figure decoupling diodes 38 and 39 are provided to prevent each secondary winding from producing current through the other. In this embodiment igniter circuit is initially supplied by winding 34A through path P2A and later supplied by winding 34B through path P2B.

It will be understood, however, that the above-described ways of connecting both secondary windings in exciting relationship to igniter 10 are exemplary only, and that the practice of the present invention is not limited thereto.

Figure 3:
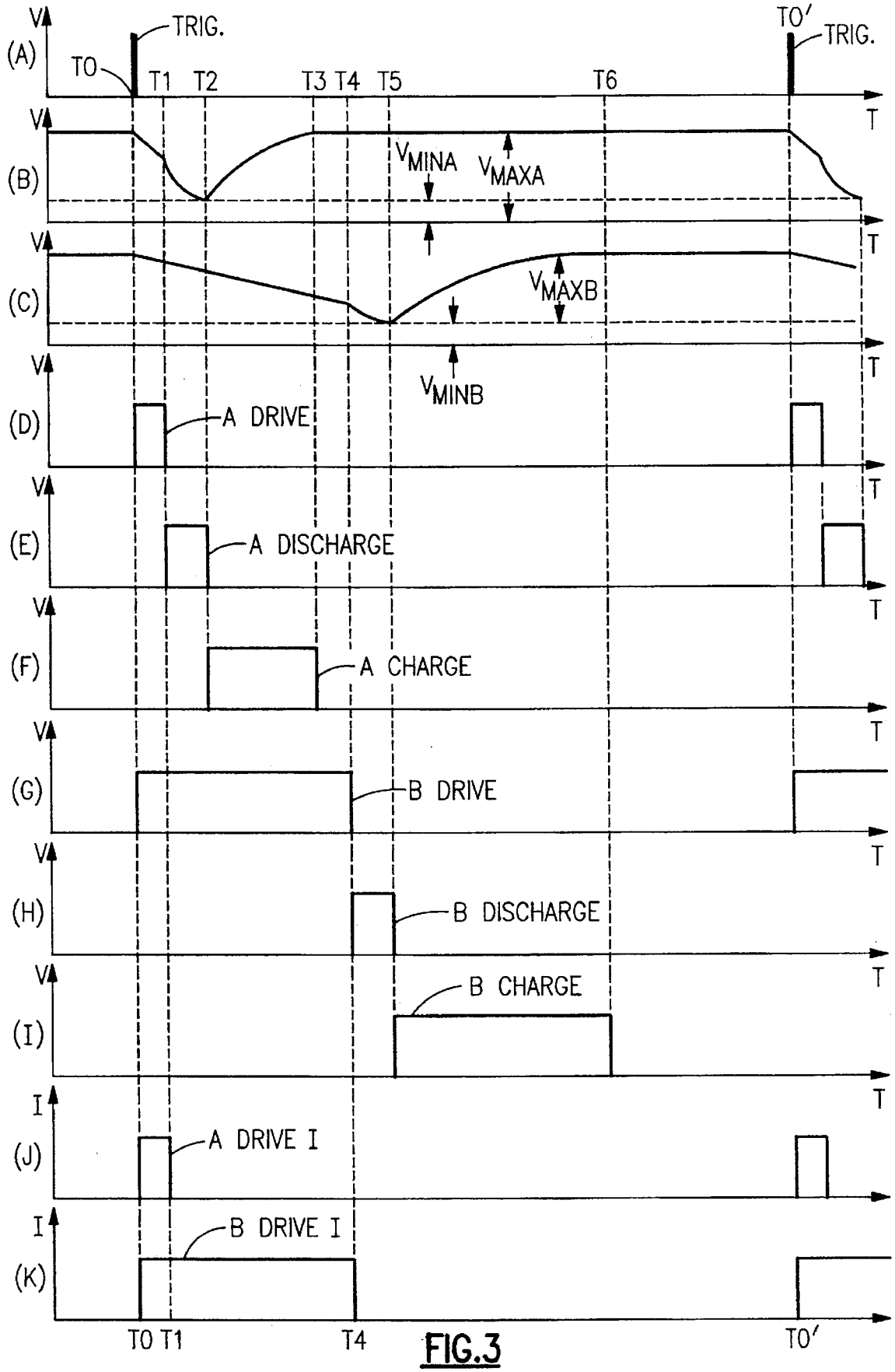
FIG. 3 shows selected ones of the voltages and currents produced by the circuits of FIGS. 1, 2 and 2A.

To the end that exciter sub-circuits 20A and 20B (often hereinafter abbreviated to exciter circuits) may apply to primary windings 32A and 32B respective component ignition or drive pulses which together cause a composite ignition pulse of the desired amplitude and waveform to be applied to igniter 10, these circuits each includes a main or drive capacitor together with a plurality of selectable circuits for controlling the charging and discharging thereof. Exciter circuit 20A, for example, includes a main or drive capacitor 40A, together with a main discharging or drive circuit controlled by a drive transistor 50A, an auxiliary discharging circuit controlled by a transistor 60A and a charging circuit controlled by a transistor 70A. When these circuits are activated by the control voltages "A DRIVE", "A DISCHARGE" and "A CHARGE" shown in FIGS. 3D, 3E and 3F, respectively, they cause capacitor 40A to undergo a discharge-charge cycle which causes its voltage to vary as shown between times T0 through T3 of FIG. 3B. As this occurs, exciter circuit 20A applies to transformer 30A a drive pulse which is primarily responsible for the early, HVLI portion of the ignition pulse shown in FIGS. 4A and 4B.

Similarly, exciter circuit 20B includes a main or drive capacitor 40B, together with main discharging or drive circuit controlled by a drive transistor 50B, an auxiliary discharging circuit controlled by a discharge transistor 60B, and a charging circuit controlled by a charging transistor 70B. When these circuits are activated by the control voltages "B DRIVE", "B DISCHARGE" and "B CHARGE" shown in FIGS. 3G, 3H and 3I, respectively, they cause capacitor 40B to undergo a discharge—charge cycle which causes its voltage to vary as shown between times T0 and T6 of FIG. 3C. As this occurs, circuit 20B applies to transformer 30B a drive pulse which is primarily responsible for the late, LVHI portion of the ignition pulse shown in FIGS. 4A and 4B.

While the currents in the above-mentioned drive, charge and discharge paths are coordinated with one another, only the drive voltages and currents are coupled to igniter 10. An idealized representation of these drive currents are shown as currents "A DRIVE I" and "B DRIVE I" in FIGS. 3J and 3K, respectively. The remaining charge and discharge currents (except as will be noted later) flow in paths that do not include transformers 30A and 30B. This fact, together with the electrical isolation between exciter circuits 20A and 20B, assures that the amplitude and duration of each drive pulse and, consequently, the amplitudes and durations of the early and late portions of the composite ignition pulse may be set, independently of one another, at whatever values are best suited to a particular ignition application. Thus, the exciter circuit of the invention is not subject to the tradeoffs and interactions which limit the use of previously known exciter circuits.

The circuits through which main capacitor 40A of exciter circuit 20A is charged and discharged during its charge-discharge cycle will now be described with reference to FIG. 1. Turning first to the charging circuit, this circuit includes a charge path that extends from a first circuit common CC1, through a DC source 90, a diode 92A, capacitor 40A, resistor 72A, the power electrodes of transistor 70A (which preferably comprises an insulated gate field effect transistor or IGFET) and a resistor 74A to circuit common CC1. Current through the latter path is controlled by control voltage "A CHARGE" which is generated by a suitable hardwired control circuit 200A of FIG. 2 (or, equivalently, the microcomputer-based control circuit of FIG. 2A) and applied to the gate and source electrodes of transistor 70A via resistors 76A, 78A and 74A and an optoelectronic isolating circuit (not shown). Also included in the charge circuit are capacitors 75A and 79A which facilitate the conduction of the transient currents that are associated with the charging of the stray capacitance of the exciter circuitry. The charge circuit preferably also includes a ferrite bead 77A for parasitic oscillation suppression.

Figure 2:
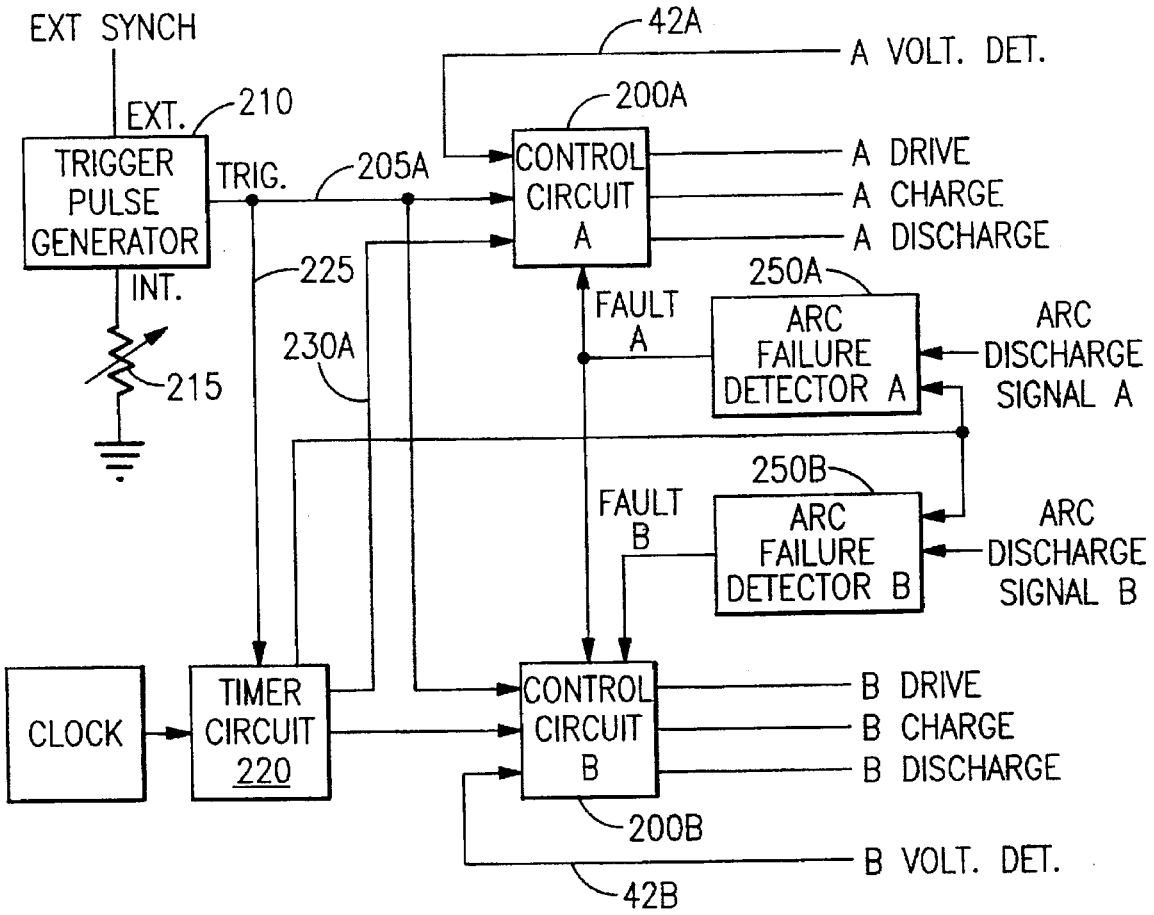
FIGS. 2 and 2A are block diagrams of two alternative control circuits suitable for use in controlling the circuit of FIG. 1.

In the embodiment of FIG. 1, the above-described charge circuit turns on to charge capacitor 40A when the voltage across the latter falls to a predetermined minimum value labelled $V_{MINA}$ in FIG. 3B. It then turns off when the voltage across capacitor 40A rises to a predetermined maximum value labelled $V_{MAXA}$ in FIG. 3B. In order to enable transistor 70A to turn on and off in accordance with these minimum and maximum voltages, the voltage across capacitor 40A is fed back to control circuit 200A of FIG. 2, which generates the control signal, A CHARGE, therefor. In FIGS. 1 and 2, this voltage is labelled "A Volt. Det." and is fed back to circuit 200A through a conductor 42A.

In accordance with the invention, the maximum value of the voltage across capacitor 40A is chosen to have a value which, when stepped up by transformer 30A, is approximately equal to the maximum voltage $V_{EMAX}$ that is to be applied to igniter 10, as shown in FIG. 4A. In a typical exciter, the maximum voltage across capacitor 40A has a value of 300 volts and transformer 30A has a secondary/primary turn ratio of 10:1, resulting in a maximum voltage of approximately 3,000 volts being applied to igniter 10. While this voltage is high enough to ionize the air gap of igniter 10, it is relatively low in comparison with the 25,000 volt gap voltages which are used in exciters of the high tension type. Thus, as stated earlier, the exciter of the invention is an exciter of the low tension type.

Turning next to the main discharge or drive circuit of exciter circuit 20A, this circuit includes a drive path that extends from a second circuit common CC2, through capacitor 40A, primary winding 32A, the power electrodes of drive transistor 50A, and a source resistor 54A back to circuit common CC2. Current through this drive path is controlled by control signal "A DRIVE" which is generated by control circuit 200A of FIG. 2 and applied to the gate and source electrodes of transistor 50A via resistors 56A, 58A and 54A and an optoelectronic isolating circuit (not shown). The drive path preferrably also includes a capacitor 55A, which corresponds to previously discussed capacitors 75A, and a ferrite bead 57A.

In the embodiment of FIG. 1, the above-described drive circuit conducts to discharge capacitor 40A through primary winding 32A only during the time that the A DRIVE pulse is present. This condition begins at time T0 with the generation of a trigger pulse TRIG. by trigger pulse generating circuit 210 of the circuit of FIG. 2 and ends at a time T1 which may be set by a hardwired drive timer (not shown) within a timer circuit 220 of the circuit of FIG. 2 or by a software timer set up by the microcomputer of FIG. 2A. Trigger pulse TRIG. may be generated either internally by an oscillator within trigger pulse generator 210 as, for example, under the control of a manually adjustable resistor 215, or in response to and in synchronism with an EXT. SYNCH signal generated by external circuitry (not shown). However it is generated, trigger pulse TRIG, is then applied in drive initiating relationship to control circuit 200A via a conductor 205A.

In the embodiment of FIG. 1, the occurrence time of the trigger pulse and consequently the beginning of the drive event is independent of the charge and discharge events. It may therefore occur at any time, provided that successive trigger pulses are not too closely spaced to permit capacitors 40A and 40B to begin their discharges at the maximum values shown in FIG. 3. In addition, the duration of the drive event in exciter circuit 20A may be set to whatever value is best suited for the combustion system with which the exciter is used by ending the drive pulse at a predetermined time after the occurrence of trigger pulse TRIG. This may be easily accomplished by applying the trigger pulse to a timer within timer circuit 220, via a trigger input conductor 225, and then applying the resulting timer output pulse to control circuit 200A via a conductor 230A to terminate drive signal A DRIVE, or by an equivalent set of timing instructions in the microcomputer of FIG. 2A.

The effect of the drive pulse of exciter circuit 20A is to maintain a high voltage across igniter 10 until the A DRIVE pulse terminates and shuts off transistor 50A. Ordinarily, however, this voltage will succeed in initiating an arc discharge in igniter 10 before the A DRIVE pulse terminates. When this arc discharge begins, the voltage across igniter 10 will decrease substantially as the ignition pulse enters the negative resistance region R(−) shown in FIG. 4A. As this occurs, the current through igniter 10 will undergo a substantial increase as shown in FIG. 4B. Provided only that exciter circuit 20B takes over the supplying of this current before transistor 50A shuts off, as will be described later, the ignition pulse will undergo a smooth transition from its HVLI phase to its LVHI phase, as shown in FIG. 4. Thus, as previously stated, the circuit of the invention is able to reliably produce both the high voltage necessary to initiate an arc discharge and the sustained high current necessary to reliably initiate combustion, even in lean fuel-air mixtures.

In a typical combustion system of the type for which the exciter of the invention is designed, the ignition pulse will have a HVLI phase with a peak voltage, VEMAX, of approximately 3,000 volts and a current ILOW of approximately 5 amperes, the latter having a duration of approximately 10 to 30 microseconds. (Not considered as a part of this phase is the current spike ICHG that is associated with the charging of the stray capacitance of the drive circuitry and has a duration of approximately 1–5 microseconds.)

In order to protect the transistors of exciter circuit 20A from the transient voltages and currents that are associated with the termination of current flow through transformer 30A, circuit 20A includes snubber circuits SN1A and SN2A. These snubber circuits serve to dissipate and dampen such transients and thereby prevent them from reaching destructively high values. Because the operation and design of snubber circuits are well known to those skilled in the art, they will not be discussed in detail herein. A measure of additional protection against such transients may also be provided by bypass diodes connected across the source-drain electrodes of the transistors of circuit 20A as shown in FIG. 1, which diodes may comprise the body diodes built in as parts of the respective IGFET's. If these body diodes do not provide sufficient transient protection, series and parallel connected external diodes, such as 51A and 51B, may be added as necessary to provide additional transient protection.

Turning finally to the auxiliary discharge circuit of exciter circuit 20A, this circuit includes an auxiliary discharge path that extends from second circuit common CC2, through capacitor 40A, a current limiting resistor 61A, the power electrodes of auxiliary discharge transistor 60A, and a resistor 64A back to common CC2. Current through this path is controlled by the control signal "A DISCHARGE" which is generated by control circuit 200A of FIG. 2 and applied to the gate and source electrodes of transistor 60A via resistors 66A, 68A and 64A and an optoelectronic isolating circuit (not shown). Also included in this circuit are capacitors 65A and 69A, which correspond to previously discussed capacitors 75A and 79A, and a ferrite bead 67A.

In the embodiment of FIG. 1, current through the above-described discharge circuit is turned on shortly after the above-described drive pulse ends, as shown in FIG. 3E. It then continues to conduct until the voltage across capacitor 40A falls to its minimum value VMINA, and then terminates when the latter voltage causes control circuit 200A to terminate the A DISCHARGE pulse at time T2. After this occurs, exciter circuit 20A will be ready for the start of the charge event described earlier in connection with transistor 70A. When the latter has been completed, exciter circuit 20A will be ready to begin the next charge-discharge cycle.

In view of the foregoing, it will be seen that the operation of exciter circuit 20A is characterized by operation in three non-overlapping, substantialy independent, unsaturated states which are established sequentially between successive pairs of trigger pulses. It will also be seen that the establishment, continuance and termination of each of these states is directly controlled by respective control signals generated by the respective control circuit of FIG. 2, although certain of these control signals are in turn controlled by other circuit variables such as VMIN. As will be explained more fully later in connection with the arc failure detecting circuitry of the invention, this makes it possible for a drive pulse to be stopped substantially instantaneously, at any time, for any length of time, and thereafter to be followed by a new drive pulse, provided only that enough time has passed for capacitor 40A to be recharged before the next trigger pulse occurs.

In the preferred embodiment, different circuit commons are utilized to simplify the IGFET drive circuits by eliminating the need for "high side driving" the solid state switching devices thereof. "High side driving" occurs when the switching device is positioned between the non-grounded terminal of the voltage source and the non-grounded terminal of the load. This circuit method also allows for the relative isolation between the current paths of the charge, discharge and drive circuits. With attention to physical layout, it also aids in isolating the low level logic control currents from the high level power currents. This preferred embodiment does not require a multiple ground system. A single ground topology could be realized, but it would have to deal with an increase in circuit complexity and increased interference between sub-circuits.

In a circuit such as circuit 20A that uses a topology in which multiple grounds (circuit commons) are present, control and detection signals must be able to travel (translate) from one ground sub-circuit to another. In the preferred embodiment, opto-isolator devices are used to maintain electrical isolation as this occurs. Other devices or circuits, such as pulse transformers, may also be used. Opto-isolators were chosen for cost, size and the ability to translate DC or long duration pulses. In addition, opto-isolators provide a barrier to the coupling of the high level power currents into the circuits of the low level logic currents.

Except as will be explained later, in connection with transformer 30B, the structure and operation of exciter circuit 20B is the same as that of exciter circuit 20A. More particularly, exciter circuit 20B includes a main discharge or drive circuit controlled by a drive transistor 50B, an auxiliary discharge circuit controlled by a transistor 60B and a charge circuit controlled by a transistor 70B. The operation and timing of these circuits are controlled by "B DRIVE", "B DISCHARGE" and "B CHARGE" signals which are generated by a control circuit 200B that operates in generally the same way as control circuit 200A. Because of the different way in which exciter circuit 20B is used, however, the occurrence times and durations of the various parts of the charge-discharge cycle thereof are different from those of exciter circuit 20A. In addition, because exciter circuit 20B is responsible for the late, LVHI portion of the ignition pulse, it operates with a transformer 30B having a turn ratio very different from that of transformer 30A. Accordingly, the following discussion of the operation of exciter circuit 20B will be confined to a discussion of how that operation differs from the operation of exciter circuit 20A.

One significant difference between exciter circuits 20A and 20B is that, in the latter, the drive pulse has a much longer duration. In particular, as shown in FIG. 3G, the B drive pulse begins at approximately the same time as the A drive event (i.e., at the beginning of the trigger pulse at time T0), but continues until time T4. This longer duration is responsible for the long duration of the late, LVHI portion of the ignition pulse, as shown in FIG. 4. Like the drive pulse of exciter circuit 20A, however, the drive pulse of exciter circuit 20B has a predetermined duration that the user may set by setting the times used by the hardwired timers of timer circuit 220, or their software equivalents in the microcomputer of FIG. 2A.

In addition, the auxiliary discharge and charge portions of the charge-discharge cycle of exciter circuit 20B have occurrence times that are determined by the end of the B DRIVE pulse and not by the end of A DRIVE pulse. In other respects, these charge and discharge events are similar to the corresponding events in exciter circuit 20A, being controlled by the minimum and maximum voltages across capacitor 40B, VMINA and VMAXB, respectively. The latter voltages are preferably, but not necessarily, equal to the minimum and maximum voltages across capacitor 40A.

Finally, because the current supplied by exciter circuit 20B has a higher magnitude and a longer duration than that supplied by exciter circuit 20A, circuit 20B is used with a transformer having a smaller turns ratio and a core with greater magnetic flux capacity. In a typical application, transformer 30B has a primary/secondary turns ratio of 4:1. As a result, if capacitor 40B has a maximum voltage of 300 volts, the voltage across secondary winding 34B of transformer 30B will be approximately 75 volts, a value that is negligible in relation to the approximately 3,000 volts across secondary winding 34A of transformer 30A. On the other hand, the current through secondary winding 34B has a value that can range from 100 amperes for long duration pulses, such as 1,000 microseconds, to 2,000 amperes for short duration pulses, such as 30 microseconds, depending upon the resistances of resistor 54B, the resistances of the transformer windings and the type of igniter being used.

Figures 6, 7:
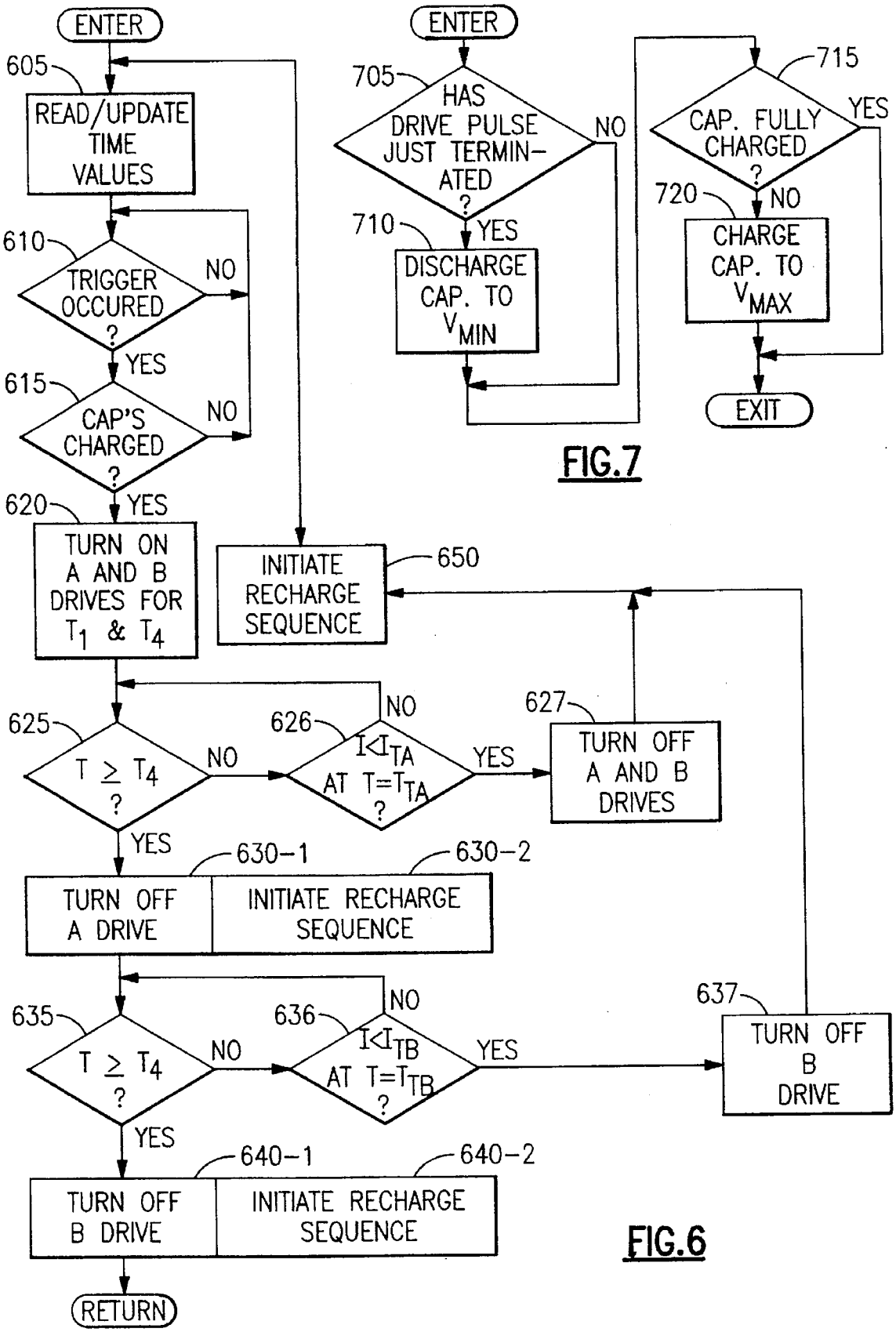
FIGS. 6 and 7 are flow charts which illustrate the operation of the control circuits of FIGS. 2 and 2A.

Based on the above described operation of exciter circuits 20A and 20B, their joint action on igniter 10 may be summarized as follows. When trigger pulse TRIG. occurs and capacitors 40A and 40B are fully charged (see blocks 610–620 of the flow chart of FIG. 6), drive transistors 50A and 50B both turn on to allow capacitors 40A and 40B to discharge through primary windings 32A and 32B, respectively. At this occurs, the voltages across series connected secondary windings 34A and 34B quickly rise to 3,000 and 75 volts, respectively, causing a voltage of about 3,075 volts to appear across gap 16 of igniter 10. The additive nature of these voltages reflects the series-aiding relationship is shown in FIG. 1A, diodes 37 being at this time reverse biased and having no effect. As this occurs, igniter 10 first operates in a glow discharge (metal-free ionization) mode and draws a low discharge current of approximately 5 amperes through windings 34A and 34B.

(In the event that secondary winding 34A and 34B are connected in the parallel-aiding relationship shown in FIG. 1B, voltage will initially be applied to the igniter only by winding 34A, diodes 39 then being reverse biased.)

As the above current continues, a tiny amount of metal from one of electrode 12 and 14 is eventually vaporized and injected into the ionized gas between electrodes 12 and 14, thus enabling the igniter to begin operating in its arc discharge mode. As this occurs, the voltage across igniter 10 falls rapidly while the current therethrough increases rapidly. (See negative resistance region R (–) of FIG. 4). The latter current supplied from secondary 34B will be impeded by the relatively high resistance and inductance of secondary winding 34A until the voltage across the igniter falls below the voltage across secondary winding 34B, so that the diodes 37 become forwarded biased, thereby allowing the igniter current to bypass winding 34A. This bypassing causes the igniter current to shift from path P1A to P2A, as shown in FIG. 1A. Under this condition, exciter circuit 20B provides the desired high magnitude current to the igniter until the B DRIVE pulse terminates at time T4 to shut off transistor 50B and thereby discontinue the ignition pulse (See blocks 635 and 640-1 of FIG. 6).

Figure 2A:
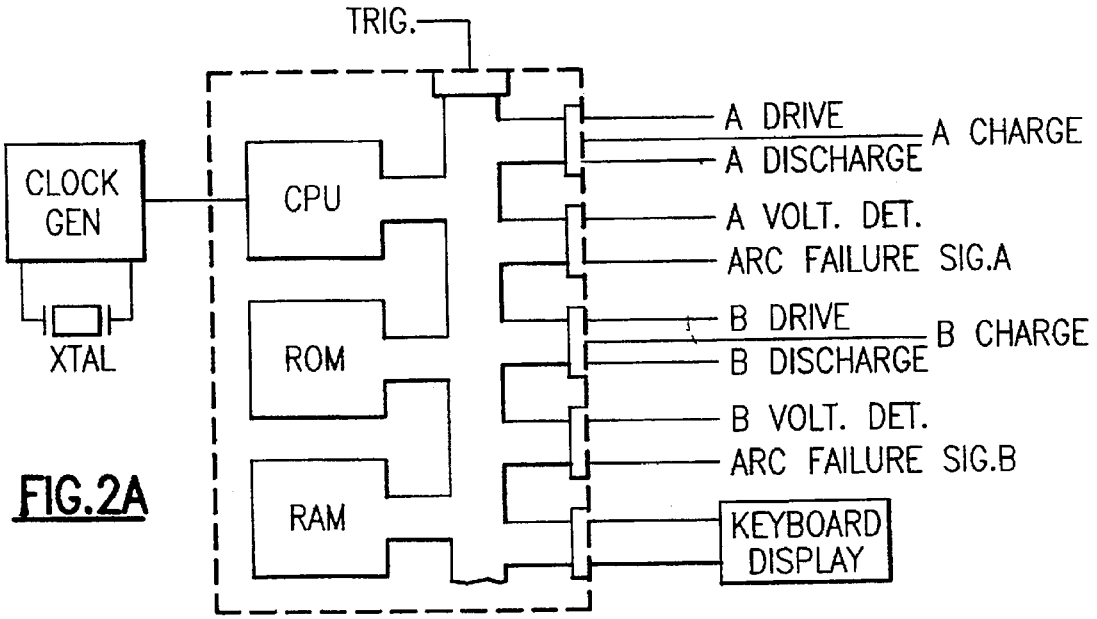

As drive transistors 50A and 50B turn off, capacitors 40A and 40B are first discharged to their predetermined minimum values, via discharge transistors 60A and 60B, and then recharged to their predetermined maximum values via charge transistors 70A and 70B, respectively. (See blocks 630-2 and 640-2 of FIG. 6, the effect of which is shown in greater detail in blocks 705–720 of FIG. 7). When this recharge sequence has been completed for both of capacitors 40A and 40B, the circuitry will ordinarily wait until the occurrence of the next trigger pulse, and then repeat the above-described sequence to apply another ignition pulse to igniter 10. If this wait period is unusually long, however, the capacitor voltages may drop as a result of leakage current flow. In the event that this drop does occur, control circuits 200A and 200B are preferrably arranged to detect this condition, via their VOLT. DET. input conductors 42A and 42B, and initiate supplementary charging activity as necessary to maintain the capacitor voltages at their desired values. If the computer based control circuit of FIG. 2A is used in place of its hardwired equivalent in FIG. 2, the need for such supplementary charging may be determined during the course of occasional executions of the subroutine shown in FIG. 7.

For the sake of clarity, the foregoing description of the charge-discharge cycle of exciter circuits 20A and 20B has not discussed saturation effects within the cores of transformers 30A and 30B, and of the measures taken or circuits used to prevent these effects from adversely affecting that cycle. These circuits and measures will now be described with reference to FIGS. 1 and 5.

In the case of transformer 30A, saturation effects are kept from adversely affecting the operation of exciter circuit 20A by utilizing a core having a size and saturation flux density great enough to prevent saturation from occurring at any time during a charge-discharge cycle of exciter circuit 20A. In addition, saturation effects that can accumulate over the course of many cycles are avoided by utilizing a core material that has a relatively low remanence or residual value. As a result, no special circuitry (other than snubbers SNIA and SN2A) or other measures are necessary to prevent the core of transformer 30A from saturating.

In the case of transformer 30B, however, the approach used with transformer 30A is not practical. This is because transformer 30B must provide a much high current for a much longer time than transformer 30A. As a result, the core of transformer 30B must be able to undergo much greater changes in magnetic flux during its drive pulse than does the core of transformer 30A during its drive pulse.

Rather than dealing with this problem by providing transformer 30B with a large, heavy core, the invention contemplates, firstly, the use of a core material having a high saturation flux density and, secondly, the provision of circuitry for resetting that core to offset the high remanence values that are associated with such cores. The B-H curve for one core material suitable for use in transformer 30B is shown in FIG. 5. As shown in FIG. 5, this material has a high saturation flux density $B_{SAT}$(e.g. 15 KG), but also has high positive and negative remanence values $+B_R$ and $-B_R$. As a result, unless provision is made to reset the core, it will end its drive pulse at the point on the B-H curve labelled X1 and, consequently, be unable to avoid saturating during the next drive pulse. In the present invention the latter problem is solved by applying to core 36B, after each drive pulse, a reset current which has the effect of moving the residual flux in core 36B from point X1 to point X2. This, in turn, assures that core 36B can support a flux change equal to $(B_{SAT}+B_R)$ during the next drive pulse and thereby avoid saturating during that pulse.

In the embodiment of FIG. 1 the current necessary to reset core 36B is applied thereto by causing the charging current for capacitor 40B to flow through primary winding 32B in resetting relationship to core 36B. This is accomplished by connecting DC charging source 90 to primary winding 32B so that charging current for capacitor 40B flows through winding 32B in a direction opposite to that in which drive current flows therethrough. Because the magnitude of this charging current will less than that of the drive current, the charging current is preferrably directed through a larger number of turns than the drive current. This difference in numbers of turns is preferrably provided by providing primary winding 32B with a tap 32B1 that allows drive current to flow through a smaller number of turns than the reset/charging current. Determining the proper number of turns that should be included on either side of this tap is simplified by the fact that the voltage across the capacitor both before and after charging are known to be equal to $V_{MINA}$ and $V_{MAXB}$, respectively. Because the manner of making this determination will be apparent to those skilled in the art, it will not be further discussed herein.

The above-described sequence of drive, discharge, and charge-reset events is the sequence that occurs when the igniter is new or at least in good working condition, i.e., an igniter whose electrodes not substantially eroded, pitted, or otherwise deteriorated. After prolonged use, however, the vaporization of the minute amounts of electrode metal that occurs during each arc discharge eventually cause the igniter electrodes to become eroded, to develop pits, and possibly transfer metal from one electrode to the other. Such deterioration can cause the igniter to present incomplete discharge patterns to the primary windings. These, in turn, can cause the primary windings to apply high current at higher than normal discharge voltages and thereby force current to flow through the body of the semiconductor pellet 16 that separates the igniter electrodes, rather than along the surface thereof. If this occurs the igniter may be irreversibly damaged and lose its ability to initiate a usable arc. The igniter and/or the exciter can also be damaged by the excessive currents that can flow when the igniter conducts current too strongly, i.e., under actual or near short circuit conditions. Thus, a need exists for the igniter and/or the exciter to be protected from both overly weak and overly strong discharge events.

In accordance with an important feature of the present invention the harmful effects of weak discharge events are reduced by providing the exciter of the invention with arc failure detecting circuitry for monitoring the ignition pulse to detect overly weak or overly strong discharge events, and by terminating one or both drive pulses as soon as possible after such events have been detected. As will be explained more fully presently, this failure detecting circuitry is arranged to determine that overly weak or overly strong firings are in progress sampling the discharge currents of the capacitors at predetermined times after the beginnings thereof. If either latter currents are found not to be within acceptable limits, the circuitry values, immediately terminates one or both drive pulses and thereafter returns the capacitors to their maximum values, to prepare them for the next trigger pulse. In this way a bad firing is in effect aborted before it becomes able to do significant damage to the igniter.

In the embodiment of FIG. 1, the failure detecting circuitry determines that an unsatisfactory igniter current is flowing in part from the voltage which the drive pulse of exciter 20A produces across source resistor 54A. The latter voltage is fed back to an arc failure detector circuit 250A of FIG. 2 as a signal labelled "ARC DISCHARGE SIGNAL A". The failure detector circuitry also determines that an unsatisfactory igniter current is flowing in part from the voltage which the drive current of exciter 20B produces across source resistor 54B. The latter voltage is fed back to an arc failure detector circuit 250B of FIG. 2 as a signal labelled "ARC DISCHARGE SIGNAL B".

Within arc failure detector 250A ARC DISCHARGE SIGNAL A is compared to a first preset reference voltage which represents the minimum drive current that will be accepted as an indication that the HVLI phase of the ignition pulse is not too weak. At the leading edge of the drive pulse, a timer is started to establish the time at which the determination will be made. In a typical application, the voltage and time may be set to detect the presence of 5 amperes (0.5 amperes at the igniter) at a time 15 microseconds into the A drive pulse. (cf. block 626 of FIG. 6) At the end of this time the output state of the comparator will be latched to an output logic level that indicates whether or not the drive current exceeded its minimum value. If it does exceed the minimum value, the drive event is allowed to continue. If it does not exceed the minimum value, arc failure detector 250A will apply a fault signal labelled FAULT A to control circuits 200A and 200B to terminate the A and B DRIVE signals. (cf. block 627 of FIG. 6) As this occurs, transistor 50A and 50B will be shut off immediately to prevent the earlier-described damage to the igniter. (Optionally, if a time delay is deliberately introduced between the leading edges of the A and B drive pulses, transistor 50B may be prevented from turning on at all.) Thereafter, the capacitors are restored to their initial condition under the control of transistors 60A and 70A. (cf. block 650 of FIG. 6.)

Similarly, within arc failure detector 250B, ARC DISCHARGE SIGNAL B is compared to a second preset reference signal which represents the minimum discharge current that will be accepted as an indication that the LVHI phase of the ignition pulse is not too weak a predetermined time after the start of the exciter B drive pulse. In a typical application, the voltage and time may be set to detect the presence of 5 amperes (20 amperes at the igniter) at a time 200 microseconds into the B drive pulse. (cf. block 636 of FIG. 6) As in the case of arc failure detector 250A, arc failure detector 250B will apply a fault signal FAULT B to control circuit 200B to terminate the B drive pulse. (cf. block 637 of FIG. 6; this condition will occur only after the occurrence time of signal FAULT A has passed.) As this occurs, transistor 50B will be turned off immediately to prevent damage to igniter 10. Thereafter, capacitor 40B is restored to its initial condition under the control of transistor 60B and 70B. (cf. block 650 of FIG. 6).

In view of the foregoing, it will be seen that, once the A and/or B drive pulses have been terminated, the capacitors of the affected exciter circuits will be prepared for the next ignition pulse in the manner described previously in connection with the flow charts of FIGS. 6 and 7. Once this preparation has been completed, the circuitry of the invention will be in condition to respond to the next occurring trigger pulse without showing any indication of, or ill effects from, the failed ignition pulse that preceded it. Thus, the arc failure detector circuitry of the invention is arranged to allow the circuitry to begin each charge—discharge cycle with a fresh opportunity to produce a usable ignition pulse.

The arc failure detector circuitry of the invention operates in a generally similar manner in the event that an excessively high current is detected during either the HVLI or LVHI phase of the ignition pulse. Arc failure detectors 250A and 250B monitor the capacitor discharge currents through resistors 54A and 54B to detect the flow of excessively high or short circuit currents. If these excessive currents are detected, one or both of the then ongoing drive pulses is terminated and the capacitors are recharged to their predetermined maximum voltages to await the occurrence of the next trigger pulse. Thus, as in the case of overly weak firings, the arc failure detector circuitry of the invention allows the exciter to begin each discharge cycle with a fresh opportunity to produce a usable ignition pulse.

In view of the foregoing, it will be seen that an exciter circuit constructed in accordance with the present invention embodies a number of improvements over previously known exciter circuits. Firstly, the exciter of the invention includes circuitry for generating, virtually independently, two component ignition pulses each of which has a magnitude, waveform and duration which is optimized for a respective part of the desired ignition event. The exciter circuit then effectively combines these pulses to produce a composite ignition pulse which initiates a spark of the desired duration substantially without overexciting or underexciting the igniter. Because of the way in which the component ignition pulses are generated allows the composite ignition pulse to be tailored to a particular ignition application, the exciter of the invention operates with improved reliability to initiate ignition events of improved flexibility, predictability and repeatability.

Secondly, the exciter of the invention includes arc failure detector circuitry for protecting the igniter from the damage that can result from weak firings, open and near open circuits and short and near short circuits. This circuitry terminates one or both of the component ignition pulses as soon as one of the currents associated therewith fails to rise above a predetermined value after a predetermined time, or rises to too high a value. By doing so, the failure detector circuitry prevents the igniter from being exposed to the excessive voltages and currents that would occur if such ignition pulses were allowed to continue, and thereby extends the useful life of the igniter.

While the exciter of the invention has been described with reference to selected specific embodiments thereof, it will be understood that the true spirit and scope of the invention should be determined with reference to the following claims.

What is claimed is:

1. An exciter circuit for producing an arc discharge between the electrodes of an igniter comprising, in combination:

first and second transformers each having a primary winding and a secondary winding;

means for connecting said secondary windings in exciting relationship to the electrodes of said igniter;

first and second capacitors;

first variable conducting means for controllably connecting said first capacitor across said first primary winding;

second variable conducting means for controllably connecting said second capacitor across said second primary winding;

control means for generating a first drive control pulse for establishing conduction through said first variable conducting means and thereby causing said first capacitor to apply a first, relatively high voltage drive pulse to said igniter, and for generating a second drive control pulse for establishing conduction through said second variable conducting means and thereby causing said second capacitor to apply a second, relatively low voltage drive pulse to said igniter;

said first and second drive pulses having durations which are independently adjustable, whereby the waveforms of the voltage across and current through said exciter may be optimized for the application in which the igniter is used.

2. An exciter circuit as set forth in claim 1 in which the magnitude and duration of said high voltage drive pulse is sufficient to initiate an arc discharge across the electrodes of said igniter, and in which the magnitude and duration of said low voltage drive pulse is sufficient to maintain said arc discharge for a predetermined time after the end of said high voltage pulse.

3. An exciter circuit as set forth in claim 1 in which said secondary windings are connected in series aiding relationship with one another, further including means for bypassing said first secondary winding after the end of said high voltage drive pulse.

4. An exciter circuit as set forth in claim 1 in which said secondary windings are connected in parallel aiding relationship with one another, further including blocking means for preventing each one of said secondary windings from establishing current flow through the other of said secondary windings.

5. An exciter circuit as set forth in claim 1 further including arc failure detecting means for detecting the presence of an unacceptable arc discharge in said igniter and discontinuing said drive pulses when said unacceptable arc discharge is present.

6. An exciter circuit as set forth in claim 5 in which said arc failure detecting means determines that an unacceptable arc discharge is present when the current through one of said variable conducting means has less than a predetermined value a predetermined time after the beginning of the respective pulse.

7. An exciter circuit as set forth in claim 5 in which said arc failure detecting means determines that an unacceptable arc discharge is present when the current through one of said variable conducting means has more than a predetermined value.

8. An exciter circuit as set forth in claim 1 further including first and second charging means for charging said first and second capacitors to predetermined first and second maximum voltages prior to the occurrence of said first and second drive pulses.

9. An exciter circuit as set forth in claim 8 in which said first and second charging means establish charging currents which flow in paths separate from said first and second variable conducting means.

10. An exciter circuit as set forth in claim 8 further including first and second discharging means for discharging said first and second capacitors to predetermined first and second minimum voltages after the ends of said first and second drive pulses.

11. An exciter circuit as set forth in claim 10 in which said first and second charging means begin the charging of said first and second capacitors when said first and second discharging means have discharged said first and second capacitors to said first and second minimum voltages.

12. An exciter as set forth in claim 10 in which said first and second capacitors are discharged through paths which are separate from the respective primary windings.

13. An exciter as set forth in claim 10 in which said control means further includes means for generating charge control pulses for controlling said first and second charging means and means for generating first and second discharge control pulses for controlling said first and second discharging means.

14. An exciter as set forth in claim 13 in which all of said drive control, charge control, and discharge control pulses are optoelectronically isolated from one another.

15. An exciter as set forth in claim 8 in which said control means further includes means for generating first and second charge control pulses for controlling said first and second charging means.

16. An exciter circuit as set forth in claim 1 further including a source of charging current for said capacitors, first controllable charging means for connecting said first capacitor across said source to charge said first capacitor to a first predetermined voltage prior to the generation of either of said drive control pulses, and second controllable charging means for connecting said second capacitor across said source to charge said second capacitor to a second predetermined voltage prior to the generation of either of said drive control pulses.

17. An exciter circuit as set forth in claim 16 in which said source is connected to said second capacitor through at least a part of the primary winding of said second transformer to apply a negative magnetic bias to said second transformer and thereby delay the onset of saturation therein.

18. An exciter circuit for producing an arc discharge between the electrodes of an igniter comprising, in combination:

first and second magnetic cores each having at least a primary winding and a secondary winding;

means for connecting said secondary windings in exciting relationship to said igniter;

first and second capacitors;

a first controllable drive device for connecting said first capacitor in discharging relationship to said first primary winding;

a second controllable drive device for connecting said second capacitor in discharging relationship to said second primary winding;

timing control circuitry for applying to the first controllable drive device a first drive control signal for causing said first controllable drive device to conduct for a first predetermined time interval, and for applying to the second controllable drive device a second drive control signal for causing said second controllable drive device to conduct for a second predetermined time interval, said second predetermined time interval being longer than said first predetermined time interval;

the turns ratio of the secondary windings to the primary windings being such that the discharge of said first capacitor applies to said igniter a first voltage high enough to initiate an arc discharge therethrough and the discharge of said second capacitor applies to said igniter a second voltage high enough to maintain an arc discharge therethrough once that arc discharge has been initiated;

said second drive control signal beginning before but ending after the end of said first drive control signal and having a duration which is independent of the duration of said first drive control signal.

19. An exciter circuit as set forth in claim 18 in which said secondary windings are connected in series with one another, further including means for bypassing said first secondary winding after said first predetermined time interval.

20. An exciter circuit as set forth in claim 18 in which said secondary windings are connected in parallel with one another, further including first unidirectional conducting means for preventing said first secondary winding from producing current flow through said second secondary winding and second unidirectional conducting means for preventing said second secondary winding from producing current flow through said first secondary winding.

21. An exciter circuit as set forth in claim 18 further including arc failure detecting means for detecting a condition in which the current through the igniter does not fall within acceptable limits and turning off any then conducting drive devices when said condition is detected.

22. An exciter circuit as set forth in claim 21 in said arc failure detecting means detects that the current through the igniter is not within acceptable limits when the current through said first drive device is less than a first predetermined value at a first predetermined time, or when the current through said second drive device is less than a second predetermined value at a second predetermined time.

23. An exciter circuit as set forth in claim 21 in which said arc failure detecting means detects that the current through the igniter is not within acceptable limits when the current through said first drive device is more than a first predetermined value, or when the current through said second drive device is more than a second predetermined value.

24. An exciter circuit as set forth in claim 18 further including a source of capacitor charging current, a first controllable charging device for connecting said source in charging relationship to said first capacitor, and a second controllable charging device for connecting said source in charging relationship to said second capacitor.

25. An exciter as set forth in claim 24 in which said first and second capacitors are charged through paths separate from said first and second drive devices.

26. An exciter circuit as set forth in claim 24 in which said source is connected to said second capacitor through at least a part of the primary winding of the second transformer to apply a magnetic bias to said core and thereby delay the saturation thereof.

27. An exciter circuit as set forth in claim 24 further including first and second controllable discharging devices for discharging said first and second capacitors to predetermined first and second minimum voltages after said first and second time intervals.

28. An exciter circuit as set forth in claim 27 in which said first and second controllable charging devices initiate the charging of said first and second capacitors after said first and second discharging devices have been discharged to said first and second minimum voltages.

29. An exciter as set forth in claim 27 in which said first and second capacitors are discharged through paths separate from said first and second primary windings.

30. An exciter circuit as set forth in claim 27 in which said timing control circuitry includes circuitry for generating first and second charge control signals for controlling said first and second charging devices, and circuitry for generating first and second discharge control signals for controlling said first and second discharge devices.

31. An exciter as set forth in claim 30 in which all of said drive, charge and discharge control signals are optoelectronically isolated from one another.

32. An exciter as set forth in claim 24 in which said timing control circuitry includes circuitry for generating first and second charge control signals for controlling said first and second charging devices.

* * * * *